US011480406B1

(12) United States Patent
Major

(10) Patent No.: US 11,480,406 B1
(45) Date of Patent: Oct. 25, 2022

(54) GRIP FOR AN ARCHERY RELEASE

(71) Applicant: BERRY MTN., INC., Liverpool, PA (US)

(72) Inventor: Jarrod Burk Major, Liverpool, PA (US)

(73) Assignee: Berry Mtn., Inc., Liverpool, PA (US)

( * ) Notice: Subject to any disclaimer, the term of this patent is extended or adjusted under 35 U.S.C. 154(b) by 0 days.

(21) Appl. No.: 17/498,159

(22) Filed: Oct. 11, 2021

Related U.S. Application Data

(63) Continuation of application No. 16/935,870, filed on Jul. 22, 2020, now Pat. No. 11,162,755.

(60) Provisional application No. 62/876,810, filed on Jul. 22, 2019.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | | |
|---|---|---|---|---|---|
| 3,845,752 | A * | 11/1974 | Barner | F41B 5/1469 | 124/35.2 |
| 4,009,703 | A * | 3/1977 | Cunningham, Sr. | F41B 5/1469 | 124/35.2 |
| 4,066,060 | A * | 1/1978 | Napier | F41B 5/1469 | 124/35.2 |
| 5,273,021 | A * | 12/1993 | Tepper | F41B 5/1469 | 124/35.1 |
| 5,765,536 | A * | 6/1998 | Scott | F41B 5/1469 | 124/35.2 |
| 7,753,043 | B1 * | 7/2010 | Eckert | F41B 5/1469 | 124/35.2 |
| 8,997,729 | B1 * | 4/2015 | Gillig | F41B 5/1469 | 124/35.2 |
| 9,243,863 | B1 * | 1/2016 | Coalson | F41B 5/148 | |
| 9,395,144 | B1 * | 7/2016 | LoRocco | F41B 5/1469 | |
| 9,618,295 | B1 * | 4/2017 | Rentz | F41B 5/1469 | |
| 9,863,736 | B2 * | 1/2018 | Kelly | F41B 5/1469 | |
| 11,125,526 | B2 * | 9/2021 | Jezwinski | F41B 5/1469 | |
| 2016/0258708 | A1 * | 9/2016 | Syverson | F41B 5/1469 | |

* cited by examiner

*Primary Examiner* — John A Ricci
(74) *Attorney, Agent, or Firm* — Hooker & Habib, P.C.

(57) ABSTRACT

A grip for an archery release includes a clip formed as a coil spring having a cross arm that is pivotally mounted to a plate to enable a cross-arm of the coil spring to be selectively positioned along different sides of the plate to change the orientation of the clip with respect to the grip.

20 Claims, 5 Drawing Sheets

GRIP FOR AN ARCHERY RELEASE

RELATED APPLICATIONS

This application is a continuation of U.S. patent application Ser. No. 16/935,870 filed Jul. 22, 2020, which in turn claims the benefit of and priority to now expired U.S. patent application Ser. No. 62/838,352 "Archery Release" filed Jul. 22, 2019 , each of the above-referenced priority documents being incorporated by reference as if fully set forth herein.

FIELD OF THE DISCLOSURE

The disclosure relates to a grip for an archery release to be gripped when drawing a bowstring, and in particular to a grip that can also position a coil spring attached to the grip in a number of different positions with respect to the grip.

BACKGROUND OF THE DISCLOSURE

Archery releases have a release head mounting a hook or pawl on a forward end of the release head that retains a bowstring while an archer is pulling on the release head to draw the bowstring. The archery release enables the archer to smoothly and consistently draw the bowstring and release the bowstring for consistent and repeatable arrow flight.

The archery release may include an elongate grip permanently or removably attached to the release head that extends away from an opposite back end of the release head.

The grip assists the archer in gripping and pulling the release head while drawing the bowstring. The free end of the grip may be attached to a wrist strap attached to the archer that enables the archer to apply more power when drawing the bowstring.

There is a need for an improved grip for an archery release that can selectively position a wrist strap or other archery accessory to suit the needs and comfort of the archer.

SUMMARY OF THE DISCLOSURE

Disclosed is a grip for an archery release. The grip is used with a clip attached to and movable with respect to the grip to form a device for attaching an accessary to an archery release. The clip can be attached to a wrist band, arm band, or other accessory of the archer. The clip is selectively positionable by the archer to a number of different orientations of the clip with respect to the grip.

The grip in embodiments can be permanently attached to a release head of an archery release or, alternatively, can be removably attached to the release head during use.

The clip in embodiments can be formed as a coil spring having a cross arm. The coil spring can be rotatably received in a through-hole of the grip. Rotation of the coil spring enables an archer to position the cross arm against respective sides of the grip to select an orientation of the coil spring with respect to the archery release. The coil spring may generate a spring force initially resisting rotation of the coil spring from one side of the grip to another side of the grip.

Other objects and features of the disclosure will become apparent as the description proceeds, especially when taken in conjunction with the accompanying drawing sheets illustrating one or more illustrative embodiments.

DETAILED DESCRIPTION

Figure 1:
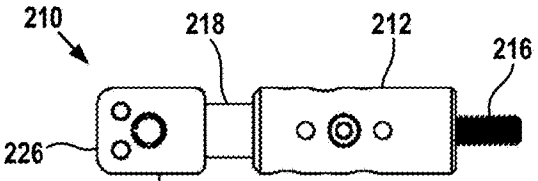
FIG. 1 is a side view of a grip for an archery release in accordance with this disclosure.
Figure 2:
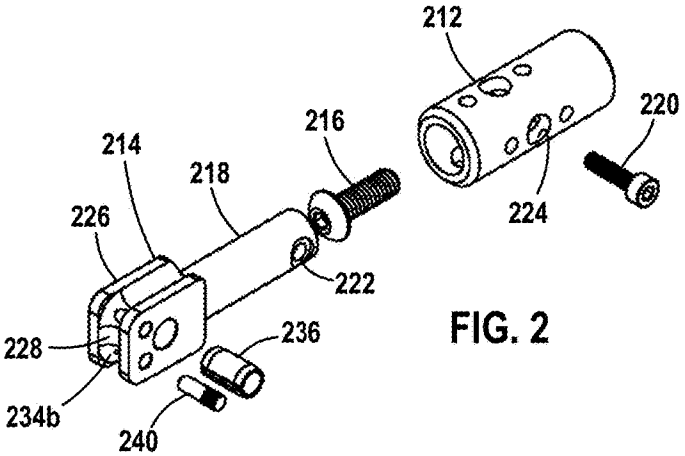
FIG. 2 is an exploded view of the grip shown in FIG. 1.

FIGS. 1 and 2 illustrate a grip 210 in accordance with this disclosure that can be used with an archery release. The illustrated grip includes a tubular module 212 on one end of the grip and a stud 214 on the other end of the grip. A threaded screw 216 extends away from the module 212 and is threaded into the release head hole 11 to attach the grip 210 to an archery release.

The stud 214 is configured to hold and orient an expandable wire coil spring in three different orientations with respect to the stud as will be illustrated in more detail below. The coil spring can carry a wrist band, arm band, or other accessory for use with the archery release.

The stud 214 includes a shaft 218 that is received into the module 212. A screw 220 passes through aligned pairs of holes 222, 224 in the stud and the module respectively to fix the stud in the module. The stud shaft extends axially away from the module to an opposite end portion 226 of the stud that carries the coil spring.

Figure 4:
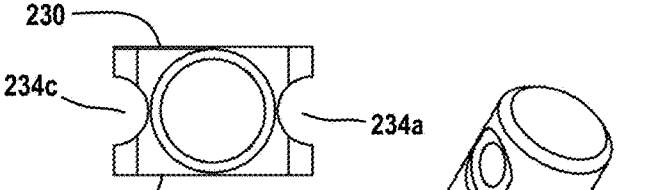
FIGS. 3 and 4 are perspective and end views respectively of the stud forming a portion of the grip shown in FIG. 1.
Figure 3:
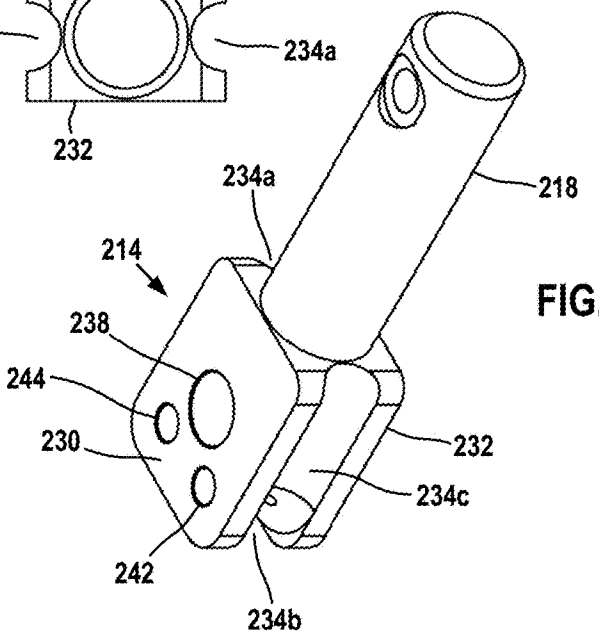

The stud 214 is shown in FIGS. 3 and 4. The end portion 226 includes a central generally rectangular plate 228 (see FIG. 2) that extends from the stud shaft 218 and is disposed between a centered pair of larger rectangular plates 230, 232. The three plates cooperate with one another to define three rounded channels 234*a*, 234*b*, 234*c* extending around three sides of the central plate 228.

A roll pin 236 (see FIG. 2) having a through-bore extends through a bore 238 extending through the center of the plates 228, 230, 232. A pair of pins 240 (one of which is shown in FIG. 2) extend through respective pairs of aligned through holes 242, 244 formed in the plates 230, 232 in a direction transverse to the shaft axis and near the intersection of the ends of the channel 234*b* and respective channels 234*a*, 234*c*.

FIGS. 5-9 illustrate a wire circular coil spring 310 held by the grip 210. The roll pin 236 is sized to rotatably receive a circular coil 312 of the coil spring extending through the bore of the roll pin. The coil spring further includes a cross arm 314 that extends across the diameter of the coil spring and is selectively received in one of the channels 234*a*, 234*b*, 234*c* to orient and hold the grip 210 with respect to the coil spring 310.

Figure 6:
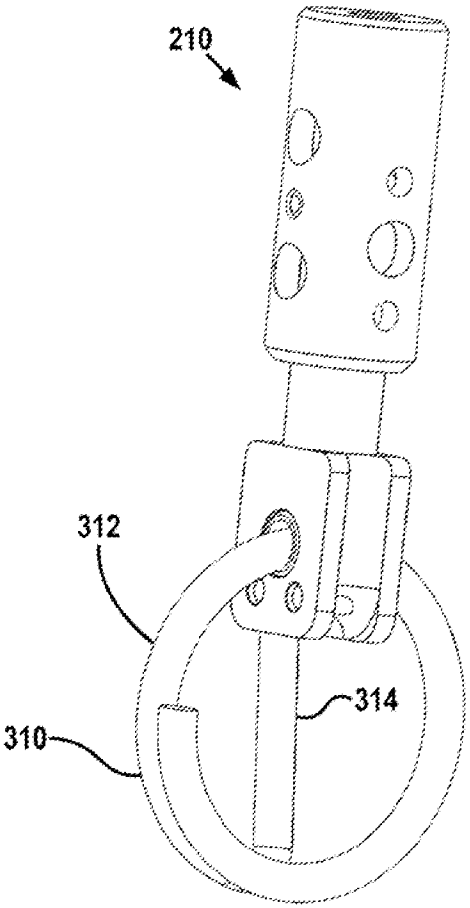
FIGS. 5 and 6 illustrate the grip shown in FIG. 1 holding a coil spring in a first orientation of the coil spring with respect to the grip.
Figure 5:
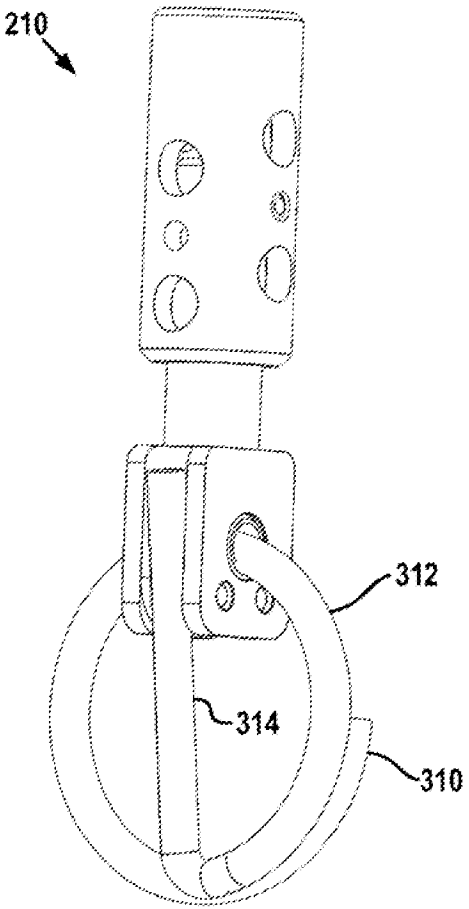

FIGS. 5 and 6 illustrate the coil cross arm 314 received in the channel 234*a*. The cross arm is deflected outwardly from its non-stressed position adjacent the coil spring by the surface of the plate 228 extending along the channel 234*a*. This generates a spring force that resists further rotation of the coil spring in the roll pin.

Figure 8:
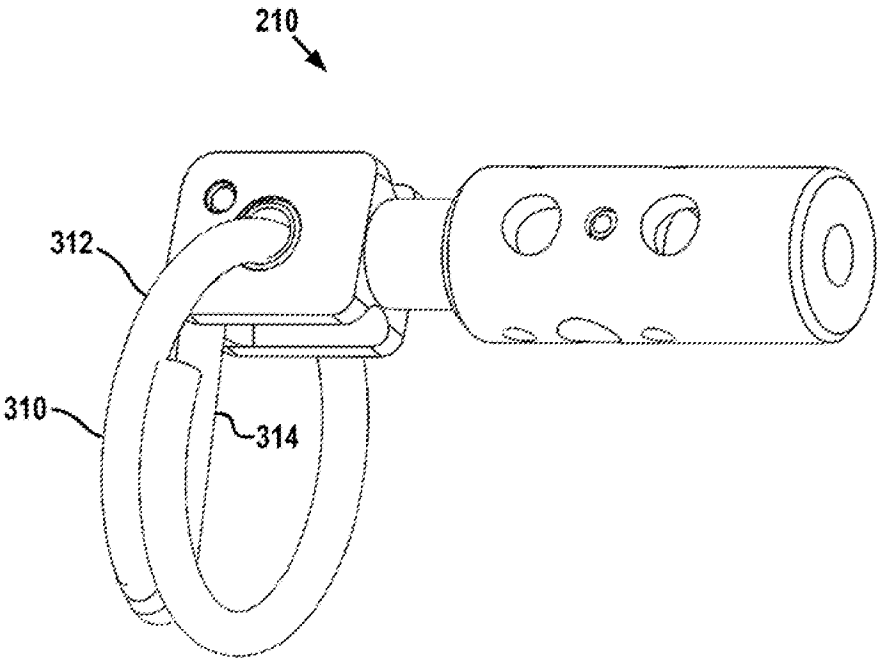
FIGS. 7 and 8 illustrate the grip shown in FIG. 1 holding a coil spring in a second orientation of the coil spring with respect to the grip.
Figure 7:
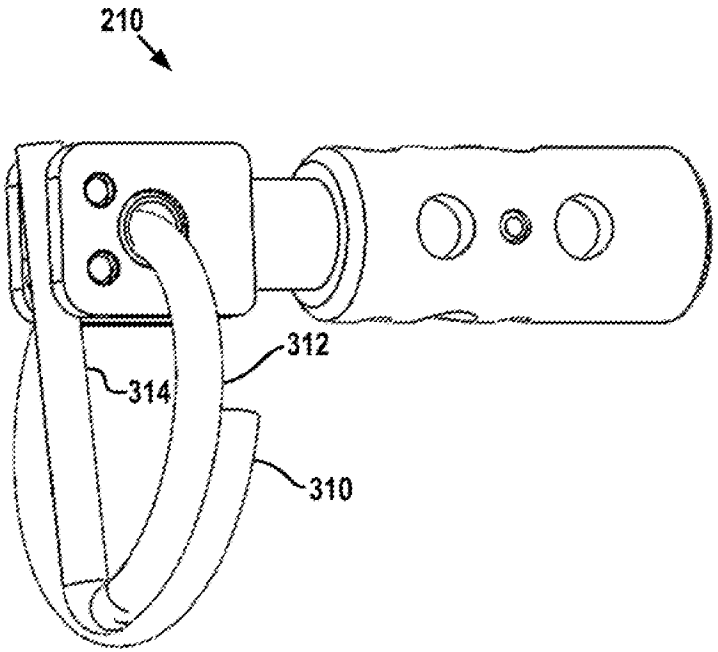

FIGS. 7 and 8 illustrate the cross arm received in the channel 234*b*. Initial rotation of the coil spring in the roll pin 236 to move the cross arm 314 out of the channel 234*a* increases the displacement of the cross arm away from the spring coil and resists rotation. Once the cross arm passes the corner of the plate 228 defining the intersection of the channels 234*a*, 234*b*, the displacement of the cross arm away from the spring coil begins to decrease, creating a "snap over center" effect that urges continued rotation of the coil spring until the cross arm is received into the channel 234*b*.

Figure 9:
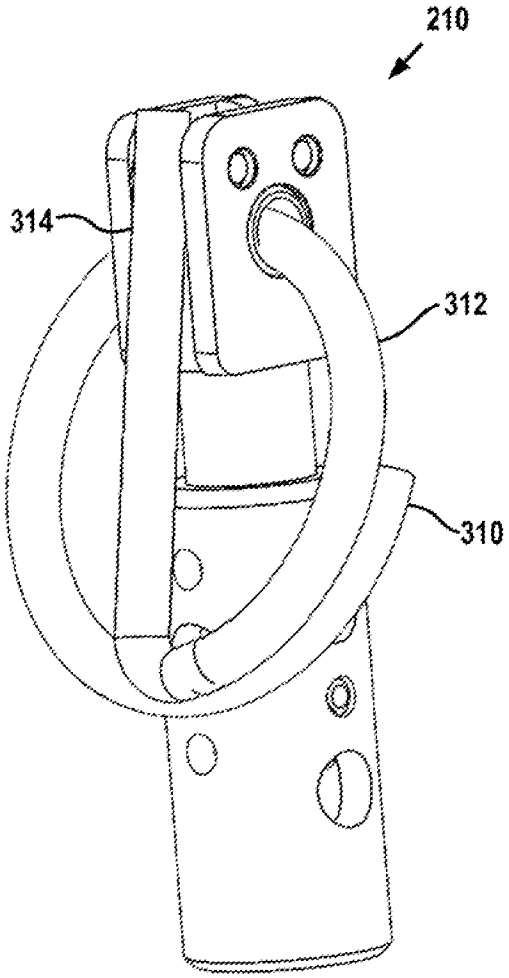
FIG. 9 illustrates the grip shown in FIG. 1 holding a coil spring in a third orientation of the coil spring with respect to the grip.

FIG. 9 illustrates the cross arm received in the channel 234*c*. The same snap over center effect occurs in moving the cross arm 314 out of the channel 234*b* and into the channel 234*c*.

The pins 240 act as bearing members that enable the cross arm 314 to more easily pivot about the corners of the plate 228 when moving between adjacent pairs of channels, and reduce wear of the plate 228.

As shown in FIGS. 5-9, the coil spring cross arm 314 cooperates with the channels 234*a*, 234*b*, 234*c* to define three relatively fixed positions of the cross arm 314 with respect to the grip 210.

Figure 11:
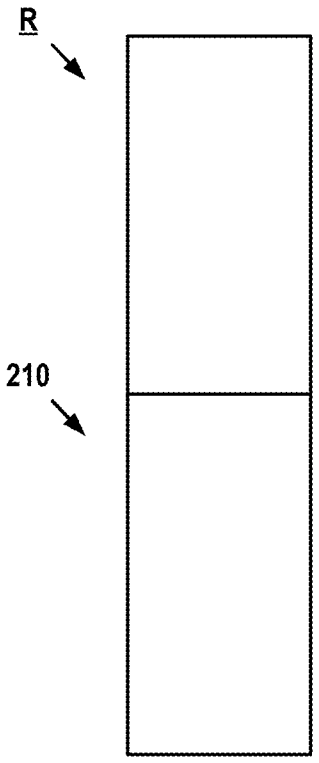
FIG. 11 schematically illustrates the grip being attached to the body of the archery release shown in FIG. 10.
Figure 10:
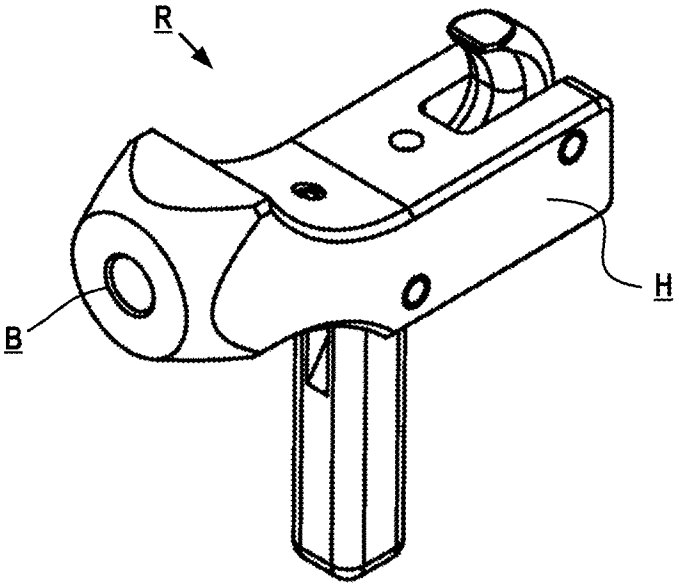
FIG. 10 illustrates an exemplar of an archery release that can be attached to the grip shown in FIG. 1.

FIG. 10 illustrates an archery release R having a release head H and a threaded bore B disposed in the back end of the body. The hole B is sized to receive the threaded screw 216 of the grip 210 and removably fasten the grip to the back end of the release. FIG. 11 schematically illustrates the grip 210 fastened to the archery release R, effectively forming an archery release with a grip in accordance with this disclosure.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) changes in material selection, size, and the like, as well as such changes and alterations that fall within the purview of the following claims.

What is claimed is:

1. A device for attaching an accessary to an archery release, the device comprising:

a grip and a coil spring;

the grip comprising:

a member having a first end and an opposite second end being spaced away from the first end along a longitudinal axis;

a central plate and a pair of larger outer plates;

the central plate being a polygon-shaped plate being disposed at the second end of the member, the central plate having N sides, one of the N sides being attached to the member and the remaining N-1 sides having exposed outer surfaces;

each of the pair of outer plates being a polygon-shaped plate being disposed at the second end of the member and having N sides, one of the N sides being attached to the member and the remaining N-1 sides being spaced outwardly from a respective adjacent side of the central plate whereby the central plate and the outer plates cooperatively define N-1 channels extending along respective N-1 sides of the central plate; and a through-hole extending through the central plate and the pair of outer plates, the through-hole spaced away from the sides of the central plate and extending along a second axis transverse to the longitudinal axis; and the coil spring comprising a coil defining a diameter dimension and a cross arm extending in a direction parallel with the diameter dimension, the coil being insertable through the through-hole, the coil spring when the coil is inserted through the through-hole being rotatable about the through-hole axis, wherein rotation of the coil spring about the through-hole axis enables the cross arm to be selectively received into a respective channel of the N-1 channels.

2. The device of claim 1 wherein the cross arm extends along a diameter of the coil and extends beyond the coil.

3. The device of claim 1 wherein N=4.

4. The device of claim 1 wherein respective adjacent pairs of sides of the N-1 sides of the central plate meet at respective corners of the central plate, and the pairs of channels associated with each of the adjacent pairs of sides intersect at a respective corner; and a bearing member extends through each of the said intersection of channels.

5. The device of claim 1 wherein each bearing member is a pin carried by the pairs of outer plates.

6. The device of claim 1 comprising a threaded shaft disposed at the first end of the member.

7. The device of claim 1 further comprising a tubular body and a threaded shaft, the tubular body having open and opposite first and second ends, the member being an elongate member extending into the tubular body to the first end of the member, and the threaded shaft extending out of the second end of the tubular body.

8. The device of claim 7 wherein the member and the tubular body are releasably fastened to each other.

9. The device of claim 1 wherein respective adjacent pairs of sides of the N-1 sides of the central plate meet at respective corners of the central plate, and the distance along each side of the adjacent pair of sides from the through-hole initially decreases as each side extends away from the respective corner.

10. The device of claim 1 being attached to an archery release head.

11. An archery release comprising a release head and a grip extending from the release head;

the grip comprising:

a member having a first end connected to the release head and an opposite second end being spaced away from the first end along a longitudinal axis;

a central plate and a pair of larger outer plates;

the central plate being a polygon-shaped plate being disposed at the second end of the member, the central plate having N sides, one of the N sides being attached to the member and the remaining N-1 sides having exposed outer surfaces;

each of the pair of outer plates being a polygon-shaped plate being disposed at the second end of the member and having N sides, one of the N sides being attached to the member and the remaining N-1 sides being spaced outwardly from a respective adjacent side of the N-1 sides of the central plate whereby the central plate and the outer plates cooperatively define N-1 channels extending along the N-1 sides of the central plate; and a through-hole extending through the central plate and the pair of outer plates, the through-hole spaced away from the sides of the central plate and extending along a second axis transverse to the longitudinal axis.

12. The archery release of claim 11 wherein N=4.

13. The archery release of claim 11 wherein respective adjacent pairs of sides of the N-1 sides of the central plate meet at respective corners of the central plate, and the pairs of channels associated with each of the adjacent pairs of sides intersect at a respective corner; and a bearing member extends through each of the said intersection of channels.

14. The archery release of claim 11 wherein each bearing member is a pin carried by the pairs of outer plates.

15. The archery release of claim 11 wherein the grip is attached to the release head by a threaded connector.

16. The archery release of claim 11 wherein the grip further comprises a tubular body and a threaded shaft, the tubular body having open and opposite first and second ends, the member being an elongate member extending into the tubular body to the first end of the member, and the threaded shaft extending out of the second end of the tubular body and into the release head.

17. The archery release of claim 16 wherein the member and the tubular body are releasably fastened to each other.

18. The archery release of claim 11 wherein respective adjacent pairs of sides of the N-1 sides of the central plate meet at respective corners of the central plate, and the distance along each side of the adjacent pair of sides from the through-hole initially decreases as each side extends away from the respective corner.

19. The archery release of claim 11 in combination with a coil spring, the coil spring comprising a coil segment passing through the through-hole of the grip, the coil spring being rotatable about a longitudinal axis passing through the through hole.

20. The archery release and coil spring of claim 19 wherein the coil spring comprises a cross arm extending parallel with a diameter of the coil spring, the cross arm being disposed in one of the N-1 channels of the grip.

* * * * *